United States Patent [19]

Scott

[11] 4,349,202

[45] Sep. 14, 1982

[54] ARROWHEAD WITH READILY REPLACEABLE BLADES

[75] Inventor: David F. Scott, Harwinton, Conn.

[73] Assignee: FAD Company, Inc., Bristol, Conn.

[21] Appl. No.: 281,958

[22] Filed: Jul. 10, 1981

[51] Int. Cl.[3] ..... F41B 5/02

[52] U.S. Cl. ..... 273/422; 30/303; 30/337

[58] Field of Search ..... 273/419–422; 30/337, 329, 339, 302, 303, 114

[56] References Cited

U.S. PATENT DOCUMENTS

| | | | |
|---|---|---|---|
| D. 232,731 | 9/1974 | Altier . | |
| D. 236,465 | 8/1975 | Hamilton | 273/421 X |
| D. 257,443 | 10/1980 | Erlandson . | |
| 427,056 | 5/1890 | Dawson et al. | 30/303 X |
| 1,162,200 | 11/1915 | Winans . | |
| 2,137,014 | 11/1938 | Brochu . | |
| 2,212,345 | 8/1940 | Krieger . | |
| 2,909,372 | 10/1959 | Neri . | |
| 2,940,758 | 6/1960 | Richter | 273/422 |
| 3,618,948 | 11/1971 | McGlocklin | 273/422 X |
| 3,672,677 | 6/1972 | Moore . | |
| 3,741,542 | 6/1973 | Karbo . | |
| 3,854,723 | 12/1974 | Wilson . | |
| 3,887,186 | 6/1975 | Matlock, Jr. | |
| 4,029,319 | 6/1977 | Christen . | |
| 4,099,720 | 7/1978 | Zeren | 273/422 |
| 4,299,402 | 11/1981 | Hoffman | 30/337 X |

FOREIGN PATENT DOCUMENTS

| | | | |
|---|---|---|---|
| 2252737 | 6/1975 | France | 30/303 |

OTHER PUBLICATIONS

Archery Magazine, 9–1958, pp. 32 & 33, Blackhawk Rocketeer.

*Primary Examiner*—Paul E. Shapiro
*Attorney, Agent, or Firm*—Ira S. Dorman

[57] ABSTRACT

An arrowhead assembly is provided in which the blades are readily removed manually, and are easily replaced. The arrowhead is effective in use, and is produced with desirable levels of facility and economy. A core member is fitted within a longitudinal slot formed in each of two interlocked, crossed delta-shaped blades. Each blade has an outwardly directed tang at the rear thereof on each side of the slot. A locking ring fits about the core member and has a cruciform shaped aperture in one end thereof. The aperture is aligned with the tangs and the ring is slid forwardly over the tangs against an abutment on the core. When the ring is rotated inwardly projecting portions defining the cruciform aperture overly the tangs and hold the blades on the core.

11 Claims, 5 Drawing Figures

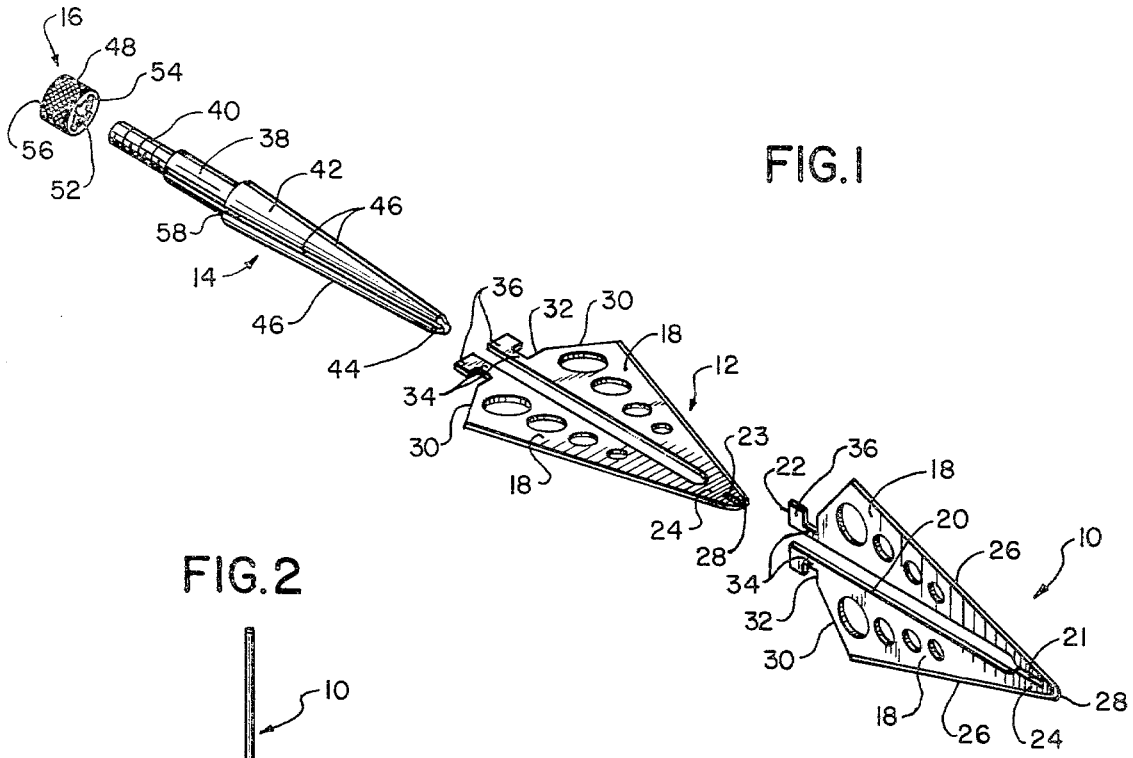
FIG.1
FIG.2
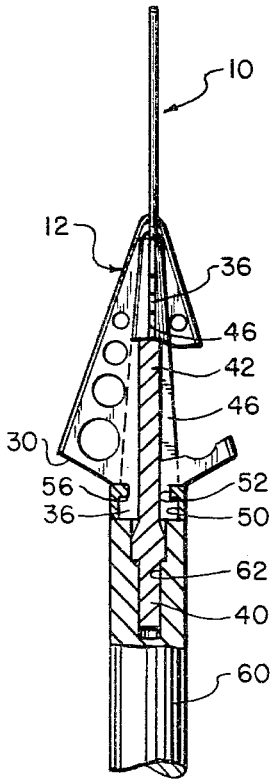
FIG.3
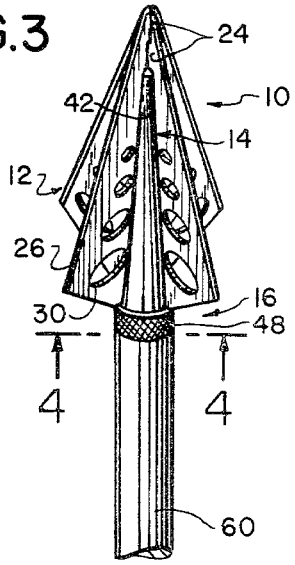
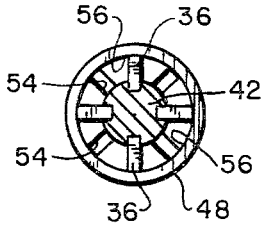
FIG.4
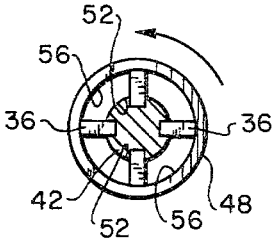
FIG.5

ARROWHEAD WITH READILY REPLACEABLE BLADES

BACKGROUND OF THE INVENTION

Heads for arrows, such as are used for game hunting, are presently available on the market which have blades that can be removed for sharpening, repair and replacement. In certain instances, such arrowheads include a solid tip behind which the forward ends of the sharpened blades are engaged. While offering the advantages of removability, a construction of that sort is somewhat undesirable in use, in that the arrow enters the prey by a piercing rather than a cutting action, thus limiting the depth of penetration; such an arrowhead is therefore less effective and humane in producing the kill. In other instances, arrowheads are provided which consist of two blades that are disposed in cross-wise or cruciform fashion, but generally, the leading edge of one of the blades is located considerably inwardly of that of the other.

The manner by which the removable blades are secured is also of primary importance to the hunter, since it is desirable that he be able to remove and replace them quickly and with a minimum amount of inconvenience. Ideally, the construction would permit replacements to be made in the field, quickly and without need of any tools. It is, of course, also important that the elements of the arrowhead be securely mounted, that the assembled arrowhead itself be strong and durable, and that its design be such as to minimize the effort and expense of manufacture.

Typical of the arrowhead constructions previously proposed are those that are described in U.S. Pat. Nos. 2,909,372, to Neri; U.S. Pat. No. 3,672,677, to Moore; U.S. Pat. No. 3,741,542, to Karbo; U.S. Pat. No. 3,854,723, to Wilson; U.S. Pat. No. 3,887,186, to Matlock, Jr., and U.S. Pat. No. 4,029,319, to Christen. As far as is known, however, no arrowhead having removable blades has heretofore been proposed or provided which offers all of the foregoing features and advantages.

Accordingly, it is an object of the present invention to provide a novel arrowhead comprised of blades that can be manually removed quickly and with great facility, and without need for any tools.

Another object of the invention is to provide such an arrowhead which is strong and durable, which consists of a minimum number of parts, which is of relatively simple design and construction, and in which the economy and facility of manufacture are optimized.

SUMMARY OF THE INVENTION

It has now been found that foregoing and related objects of the invention are readily attained in an arrowhead assembly comprising first and second, generally delta-shaped blades; a core member on which the blades are mounted, and a locking member which serves to secure the blades in assembly. Each of the blades has a longitudinal slot extending forwardly from the rear end thereof and defining thereon a pair of symmetrically disposed blade members. The blade members have first outer edge elements that converge forwardly from a first point to a tip portion of the blade, and second outer edge elements that converge rearwardly to an engagement portion adjacent the slot in the blade; the first edge elements are sharpened along at least a pair of their length. The "second" blade is seated within the slot of the "first" blade, with its tip portion fixedly engaged behind the tip portion of the first blade, and with the slots thereof substantially coextensive. The engagement portion of at least the first blade includes a narrow prong, which extends rearwardly from each blade member thereof and has an outwardly projecting lug thereon. The core member includes an element providing a rearwardly disposed abutment surface, and is inserted axially into the coextensive slots of the blades to provide support therefore with the lugs of the first blade spaced from the abutment surface of the core member. It also includes a shank portion extending rearwardly therefrom beyond the blades, and the shank portion has means thereon for attachment to an arrow shaft. The locking member is mounted on the shank portion of the core member adjacent its abutment surface, and has a plurality of peripherally spaced engagement elements adjacent one end thereof and extending inwardly into the passage therethrough, thereby defining a coaxial aperture of reduced relative dimensions. The engagement elements of the locking member lie within the spaces between the lugs of the "one" blade and the abutment surface of the core member, and lock the lugs therebehind. Turning of the locking member on the shank portion achieves an unlocked position, in which the lugs can pass through the peripheral gaps between the engagement elements thereof, thus permitting the blades to be dismounted forwardly therefrom.

In the preferred embodiments of the assembly, the first blade has a second longitudinal slot formed therein, which is narrower than the first-mentioned slot and extends forwardly into the tip portion of the blade therefrom. A similar "second" slot is also formed in the second blade, but it extends longitudinally rearwardly into the tip portion from the forward edge thereof. In this manner the tips of the blades are interengaged, with a portion of each lying within the "second" slot of the other, and with their leading edges coincident, to cooperatively provide the point of the arrowhead.

Most desirably, the engagement portion of both blades will include prongs having lugs thereon, and the locking member will have at least four engagement elements to effect engagement with the lugs of all of the prongs. Generally, the engagement portion of at least the first blade will comprise a third edge element extending between the second edge element and the prong of each of its blade members, and lying substantially flush with the abutment surface of the core member.

Normally, the outer surface of the core member will be longitudinally grooved to slidably engage the inner margins defining the first-mentioned slots of the blade members. It will also usually include an enlarged head portion at its forward end, with the rear end of the head portion providing the defined abutment surface. Generally, the head portion will be of circular cross-section, and ideally of a substantially conical configuration with a taper that extends forwardly to a relatively pointed end. The grooves formed in the head portion will advantageously be disposed at 90° intervals thereabout, thus imparting to the assembly a substantially cruciform cross-section, and its shank portion will conveniently have a threaded end to provide the means for attachment to the arrow shaft. Finally, the locking member will desirably be a ring or collar of a generally cup-like construction, wherein the end wall has a circular opening and radial slots formed therethrough, together defining the necessary engagement elements for locking of the blade lugs.

BRIEF DESCRIPTION OF THE DRAWINGS

FIG. 1 is an exploded perspective view of an arrowhead assembly embodying the present invention;

FIG. 2 is a fragmentary view, in partial section, of the assembly of FIG. 1, mounted upon the shaft of an arrow and showing one of the blades partially removed;

FIG. 3 is a fragmentary perspective view of the assembly mounted upon the shaft of an arrow;

FIG. 4 is an enlarged sectional view taken along line 4—4 of FIG. 3, showing the locking ring in position to lock the blades upon the core member; and FIG. 5 is a view similar to FIG. 4, showing the ring in unlocked position.

DETAILED DESCRIPTION OF THE ILLUSTRATED EMBODIMENT

Turning now in detail to the appended drawing, therein illustrated is an arrowhead assembly embodying the present invention and consisting of generally delta-shaped outer and inner blade, a core member, and a locking ring or collar, generally designated by the numerals 10, 12, 14 and 16, respectively. The blades 10, 12 are, to a large extent, of identical construction, and therefore specific reference to the inner blade 12 will be limited, it being understood however that features that are common to both blades bear the same numbers. Blade 10 is divided into two mirror-image blade members 18 by a slot 20, which extends longitudinally from the rear end 22 to the tip portion 24 thereof. Each blade member 18 has a sharpened side edge element 26, which elements converge to a sharpened leading edge 28. Converging rearwardly from the sharpened edges 26 are following edge elements 30, each of which merges into a short engagement edge element 32, the latter being oriented perpendicularly to the axis of the slot 20. Short prongs 34 extend rearwardly from the edges 32, and have lugs 36 disposed at their free ends; as can be seen, each lug 36 is separated from the main body of the blade 10 by a shallow, U-shaped recess (unnumbered).

The essential difference between the blades 10 and 12 lies in specific locations of the minor slots that are provided in the tip portions 24 thereof. More particularly, in the outer blade 10 a relatively narrow slot 21 extends from the forwardmost end of the major slot 20 in axial alignment therewith. On the other hand, the minor slot 23 of the blade 12 extends inwardly from its leading edge 28, although it is also axially aligned with the major slot 20 and is of the same width as slot 21. The tip portion 24 of the blade 12 is engaged behind and interfit with the tip portion 24 of the blade 10 by interengaging the slots 21, 23, and the sharp leading edges of both cooperate to provide the point of the arrowhead. As will be noted, each blade member has formed through it a series of unnumbered circular apertures of graduated size, which serve to avoid wind planing and thereby to ensure true flight of the arrow.

The core member 14 consists essentially of a shank portion 38 having a threaded tip 40 at its rear end, and a sharply tapered conical head portion 42 at its forward end, which terminates in a chamfered tip 44 and provides the abutment surface 58 on its opposite end. Four elongated grooves 46 extend from the tip 44 to points adjacent the threaded end 40, and are disposed circumferentially at 90° intervals about the core member 14.

The ring 16 is of generally cup-like construction, and has an externally knurled sidewall 48 defining a central passageway 50, and an end wall formed with a central aperture 52 and slot elements or gaps 54 formed crosswise therein at 90° intervals. The aperture 52 and the slot elements 54 define inwardly projecting fingers or engagement elements 56, which function in a manner to be more fully described presently.

The arrowhead may be assembled by initially interengaging the blades 10 and 12 by mutual insertion of their respective tip portions 24, utilizing the slots 21 and 23, as previously described. The resultant sub-assembly is then mounting by sliding the core member 14 into the coextending major slots 20, with the inner marginal portions of the blade members 18 (defining the slots 20) engaged within its longitudinal grooves 46. Thereafter, the locking collar 16 will be placed upon the shank portion 38, and so oriented as to permit the four lugs 36 of the two blades 10, 12 to pass through the gaps 54 between the fingers 56. When the collar 48 is in position against or closely adjacent the abutment surface 58, it can be rotated slightly, thereby engaging the lugs 36 behind the fingers 56. The assembled arrowhead will be mounted upon the arrow shaft 60, the leading end of which is provided with an appropriately threaded bore 62 for that purpose.

The locked and unlocked conditions of the assembly are best illustrated in FIGS. 4 and 5, respectively. As can be seen in FIG. 4, the collar 16 is oriented with the gaps 54 between the fingers 56 displaced by about 45° from the blade lugs 36, thus locking them in position. FIG. 5 depicts the collar 16 rotated to align the lugs and the gaps, thus permitting disassembly of the blades 10, 12 from the core 14. Partial removal of the outer blade 10 is shown in FIG. 2 and, as will be evident therefrom, the blade assembly need not be removed from the arrow shaft 60 for that purpose; this may be most advantageous from the standpoints of facilitating manipulation and quick replacement of blades.

The particular configuration and construction of the blades utilized in the assembly of the present invention may, of course, deviate considerably from the structures shown in the drawing without departing from the scope of the invention. Thus, other means may be utilized to interengage the two blades with one another, and the overall configuration and details of the blade members may be modified, if so desired. Similarly, the structure of the core member may vary from that illustrated, albeit that it is preferably of circular cross-section, and most desirably of the conical configuration shown, since such a structure affords high levels of support for the blades without interfering with good penetration into the animal.

The materials of construction utilized for the present assembly will be evident to those skilled in the art, and need not be discussed in detail. Suffice to say that the blades will normally be produced of stainless or high carbon steel, and the core member and locking collar will desirably be made of aluminum; however, it may be possible to substitute molded plastic parts for the latter, with concomitant manufacturing and economic benefits.

Thus, it can be seen that the present invention provides a novel arrowhead assembly in which the blades are readily and conveniently removed and replaced manually, without the need to use any tools. The arrowhead is of a construction that will maximize its effectiveness, while at the same time affording relatively facile and inexpensive manufacture, being comprised of a minimum number of relatively simple parts. Despite its simplicity and convenience of use, the parts of the assembly are securely supported and engaged with one another, and together provide a unitary structure that is strong and durable.

Having thus described the invention, what is claimed is:

1. An arrowhead assembly comprising: first and second generally delta-shaped blades, each blade having a longitudinal slot extending forwardly from the rear end thereof and defining a pair of symmetrically disposed blade members having first outer edge elements that converge forwardly from a first point to a tip portion of said blade and are sharpened along at least a part of their length, and having second outer edge elements that converge rearwardly therefrom to an engagement portion adjacent said slot therein, said second blade being seated within said slot of said first blade with said tip portion thereof fixedly engaged behind said tip portion of said first blade and with said slots thereof substantially coextensive, said engagement portion of at least said first blade including a narrow prong extending rearwardly from each blade member thereof and having an outwardly projecting lug thereon; a core member inserted axially into said coextensive slots of said blades and providing support therefor, said core member having an element providing a rearwardly disposed abutment surface, and having a shank portion extending rearwardly therefrom beyond said blades with said lugs of said first blade spaced from said abutment surface, said shank portion having means thereon for attachment to an arrow shaft; and a locking member mounted on said shank portion of said core member adjacent said abutment surface thereof, said locking member having a passageway therethrough and a plurality of peripherally spaced engagement elements adjacent one end thereof and extending inwardly into the passageway therethrough to define a coaxial aperture of reduced relative dimensions, said engagement elements of said locking member lying within the spaces between said lugs of said one blade and said abutment surface of said core member, and locking said lugs therebehind, said locking member being rotatable on said shank portion to an unlocked position in which said lugs can pass through the peripheral gaps between said engagement elements thereof, thereby permitting said blades to be dismounted forwardly from said core member.

2. The assembly of claim 1 wherein said first blade has a second longitudinal slot formed therein which extends forwardly into said tip portion from said first-mentioned slot thereof and is of lesser relative width, and wherein said second blade has a second slot of a width corresponding to said second slot of said first blade and extending longitudinally rearwardly into said tip portion from the forward end thereof, said blades being of substantially equal thickness and being interengaged with a portion of each of said blades lying within said second slot of the other of said blades.

3. The assembly of claim 1 wherein said engagement portion of said second blade also includes said prongs on said blade portions thereof, said locking member having at least four of said engagement elements to effect locking engagement with said blade lugs.

4. The assembly of claim 2 wherein said engagement portion of at least said first blade includes a third edge element on each of said blade members extending between said second edge element and said prong thereof and perpendicularly to the axis of said longitudinal slot, said third element lying substantially flush with said abutment surface of said core member.

5. The assembly of claim 1 wherein the outer surface of said core member is grooved longitudinally to slidably engage the inner margins of said blade members defining said longitudinal slots thereof.

6. The assembly of claim 5 wherein said grooves are disposed at 90° intervals about said core portion, said assembly being of substantially cruciform cross-sectional configuration.

7. The assembly of claim 1 wherein said core member includes an enlarged head portion at the forward end thereof, said element providing said abutment portion being on said head portion and disposed at the rear end thereof.

8. The assembly of claim 7 wherein said head portion is of substantially conical configuration and tapers forwardly to a pointed forward end.

9. The assembly of claim 1 wherein said shank portion of said core member is threaded at its rearmost end to provide said attachment means thereof.

10. The assembly of claim 1 wherein said locking member is a generally cup-like ring structure, the end wall thereof having a circular aperture and radial slots formed therethrough to provide said engagement elements thereon.

11. The assembly of claim 1 wherein said tip portions of said blades are sharp and coincident, to cooperatively provide the point of said arrowhead.

* * * * *